US006945817B2

(12) United States Patent
Miyazaki et al.

(10) Patent No.: US 6,945,817 B2
(45) Date of Patent: Sep. 20, 2005

(54) CONNECTING STRUCTURE FOR ELECTRIC WIRE TO SHIELD CASE OF APPARATUS

(75) Inventors: Sho Miyazaki, Mie (JP); Hiroshi Aihara, Aichi (JP); Kei Sasaki, Aichi (JP)

(73) Assignees: Autonetworks Technologies, Ltd., Mie (JP); Sumitomo Wiring Systems, Ltd., Mie (JP); Sumitomo Electric Industries, Ltd., Osaka (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/806,176

(22) Filed: Mar. 23, 2004

(65) Prior Publication Data

US 2004/0229508 A1 Nov. 18, 2004

(30) Foreign Application Priority Data

Mar. 24, 2003 (JP) ..... P2003-081150

(51) Int. Cl.[7] ..... H01R 9/05
(52) U.S. Cl. ..... 439/579; 439/578
(58) Field of Search ..... 439/579, 578, 439/587–589, 76.2, 608, 610, 98

(56) References Cited

U.S. PATENT DOCUMENTS 3,852,700 A * 12/1974 Haws ..... 439/98
4,897,046 A * 1/1990 Tengler et al. ..... 439/579
5,046,966 A * 9/1991 Synder et al. ..... 439/579
5,906,511 A * 5/1999 Bozzer et al. ..... 439/579
6,168,465 B1 * 1/2001 Hirota ..... 439/579
6,386,914 B1 * 5/2002 Collins et al. ..... 439/579
6,468,089 B1 * 10/2002 Hubbard et al. ..... 439/63
6,619,985 B1 * 9/2003 Ko ..... 439/607
6,699,073 B1 * 3/2004 Wu ..... 439/608
2002/0132522 A1 9/2002 Miyazaki et al.

FOREIGN PATENT DOCUMENTS

JP A 2002-125348 4/2002

* cited by examiner

*Primary Examiner*—Gary Paumen
(74) *Attorney, Agent, or Firm*—Oliff & Berridge, PLC

(57) ABSTRACT

Therein is provided with a connecting structure to the shield case of an apparatus so that a number of the connector parts are decreasing and that connecting operation is facilitated. The connector includes a insulative first housing fixed in a state of being inserted into a through hole, a first terminal held by the housing to face the through hole and connected to the electric circuit. The second housing of the electric wire side is fitted to the first housing. The second terminal is connected to the first terminal. Sealing rings are provided between the outer periphery of the housings and the through hole on outer periphery of the housings so that the bracket fixed to the shield case is electrically connected to shield layer of the shield electric wire. A connecting member electrically connects the bracket and the shield layer outside of the second housing.

6 Claims, 7 Drawing Sheets

CONNECTING STRUCTURE FOR ELECTRIC WIRE TO SHIELD CASE OF APPARATUS

BACKGROUND OF THE INVENTION

1. Field of the Invention

The present invention relates to a structure of connecting an electric wire to a shield case of an apparatus.

2. Description of the Related Art

There is used a structure of connecting an electric wire to a shield case for connecting apparatus of an inverter apparatus, a motor and the like in, for example, electric motor. There is an electric wire connecting structure of this kind in which an electric wire side terminal is fixedly connected to an end portion of a conductor of a shield electric wire, the electric wire side terminal is connected to an apparatus side terminal provided at inside of a shield case of an apparatus and a shield layer of the shield electric wire is connected to a shield case via a conductive connecting member (refer to, for example, JP-A-2002-125348).

Meanwhile, there is provided a shield connector of a prior art in which terminals are fixed by a bolt at inside of a shield case and according to such a constitution of connecting the terminals by fastening the bolt, there are needed an opening portion constituting an operating port for fastening the bolt, a lid for closing the opening portion to waterproof, a number of parts is liable to increase and the constitution cannot be regarded to be excellent in operability.

SUMMARY OF THE INVENTION

It is an object thereof to provide a structure of connecting an electric wire to a shield case of an apparatus capable of being fabricated inexpensively by reducing a number of parts and capable of simply carrying out connecting operation. According to one aspect of the invention, there is provided with a connector including a metal shield case having an electric circuit, a first housing fixed in a state of being inserted into a through hole, a first terminal held by the firs housing to face the through hole and connected to the electric circuit, a seal ring provided at least on an outer periphery of the first housing for sealing an interval between the outer periphery of the first housing and the through hole, and a metal bracket fixed to the metal shield case, and a shield electric wire including; a center wire; a shield layer around the center wire electrically connected to the electric circuit, an insulative second housing fitted to the first housing by being inserted into the through hole; and an second terminal held by the second housing by being connected to the center wire of the shield electric wire and connected to the first terminal in fitting the second housing and the first housing to each other.

Further, according to another aspect of the invention, the bracket is constituted to fix the electric wire side housing in a state of being fit to the apparatus side housing by being integrally provided to the electric wire side housing and fixed to the shield case.

Further, according to yet another aspect of the invention, the apparatus side terminal includes a terminal main body penetrated in a front and rear direction through inside of the apparatus side housing and a fitting projected portion projected from the terminal main body to a front side, the electric wire side terminal is constituted to include a fitting recess portion constituted to insert the fitting projected portion to inside thereof, and the terminals are connected by fitting the fitting projected portion and the fitting recess portion to each other.

According to yet another aspect of the invention, a plurality of the shield electric wires are provided and respective pluralities of the apparatus side terminals and the electric wire side terminals are provided to correspond to the respective shield electric wires.

Further, according to yet another aspect of the invention, a plurality of the through holes are formed in the shield case and in at least either one housing of the apparatus side housing or the electric wire side housing, a plurality of housing elements inserted into the respective through holes are formed to be integrally continuous at external portions of the through holes.

Further, according to yet another aspect of the invention, there is provided with a member for electrically connecting the bracket and the shield layer at an external portion of the electric wire side housing, wherein on the other hand, an inner portion of the electric wire side housing includes a cavity inserted with the shield electric wire and a seal member for sealing the shield electric wire and the electric wire side housing is arranged at an inner portion of the cavity.

In the structure of connecting an electric wire to a shield case of an apparatus, connection between the electric wire side terminal provided on a side of the shield electric wire and the apparatus side terminal provided on a side of the, apparatus is carried out only fitting the electric wire side housing and the apparatus side housing and therefore, it is not necessary to connect the terminals by troublesome bolt fastening operation, and the invention is excellent in operability. Further, although when the terminals are connected by fastening a bolt, it is necessary to cover a cover for protection at a portion of connecting the terminals after fastening the bolt, according to the invention, there is constituted a state in which the two terminals are contained at inside of the attaching hole and therefore, it is not necessary to cover the cover and a number of parts can effectively be reduced. Further, there is constructed a constitution in which the apparatus side housing is inserted into the through hole, the seal ring is arranged at the surrounding of the apparatus side housing and therefore, oil or the like is prevented from invading from the side of the apparatus while constituting a structure of fitting the through hole and the apparatus side housing and protection of inside of the through hole is effectively carried out.

According to the invention, the connecting serves a function as shield member and also serves as a function for attaching the electric wire side housing to the shield case and therefore, it is not necessary to provide a special member for attaching the electric wire side housing to the shield case, which contributes to a reduction in a number of parts, a reduction in cost or the like.

According to the invention, a shape of the apparatus side terminal can be constituted by a simple shape without being complicated and therefore, there is constructed a constitution in which a clearance or the like is difficult to be brought about and waterproof performance is easy to ensure and the shape becomes also a shape excellent in water proof performance and easy to carry out molding.

According to the invention, in a multi electrode structure in which a number of parts is increased and a shape thereof is liable to be complicated, a reduction in a number of parts and simplification of the shape are achieved to construct a constitution having high usefulness.

According to the invention, in at least one of the housings, the plurality of housings are integrally formed and therefore, a number of parts can effectively be reduced.

According to the invention, the electric connection is carried out by the connecting member at the external portion of the electric wire side housing and therefore, it is not necessary to provide a structure for the connection at inside of the electric wire side housing and an inner structure thereof can be simplified and therefore, (specifically, the inner structure can be constituted as a smooth inner peripheral face and therefore,) when the seal member for sealing the shield electric wire and the electric wire side housing are provided at the inner portion of the electric wire side housing, a constitution having a high seal effect is constructed.

DESCRIPTION OF THE PREFERRED EMBODIMENTS

An explanation will be given of Embodiment 1 embodying the invention in reference to FIG. 1 through FIG. 9 as follows.

Figure 1:
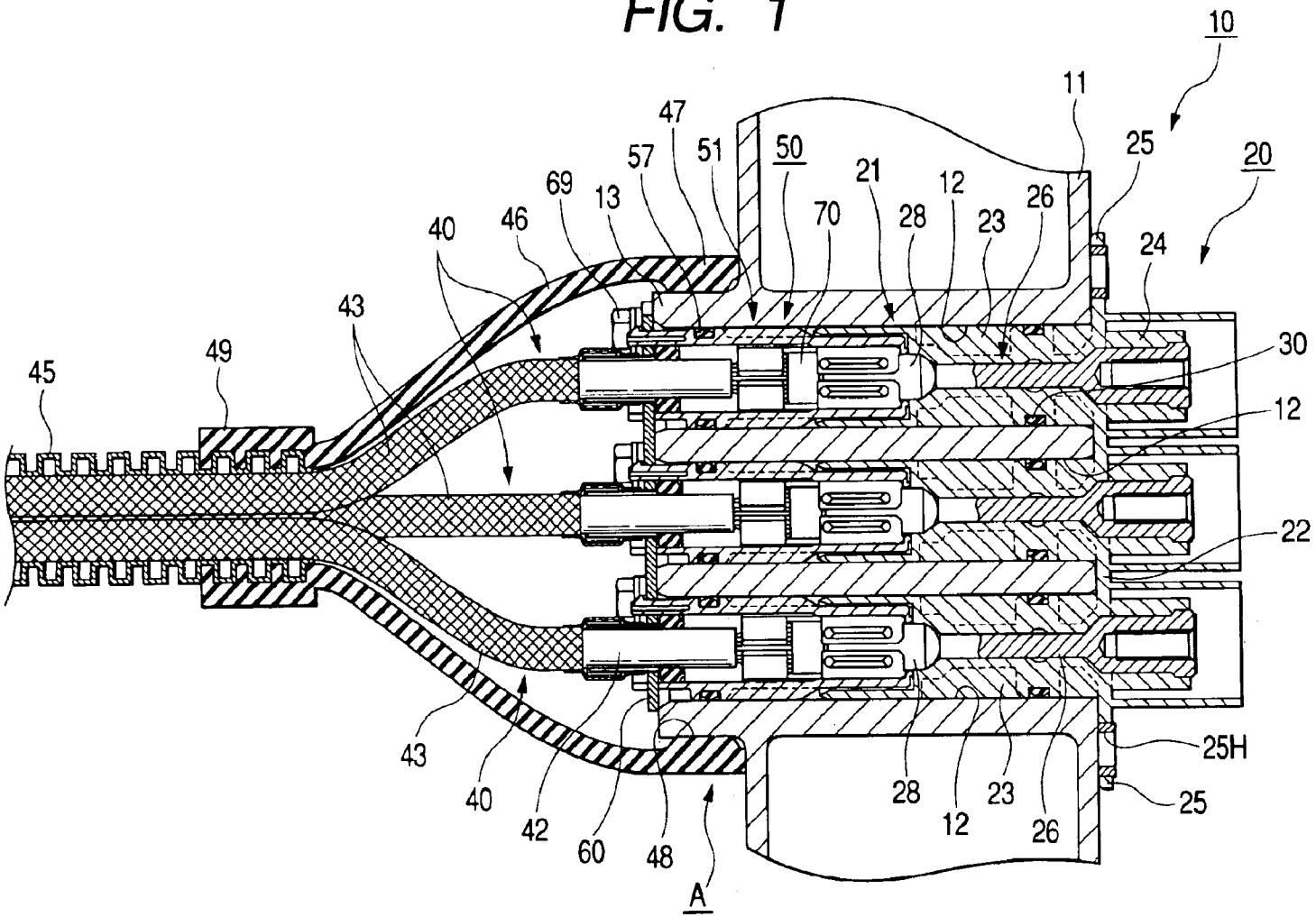
FIG. 1 is a horizontal sectional view showing an integrated state of a first embodiment.
Figure 2:
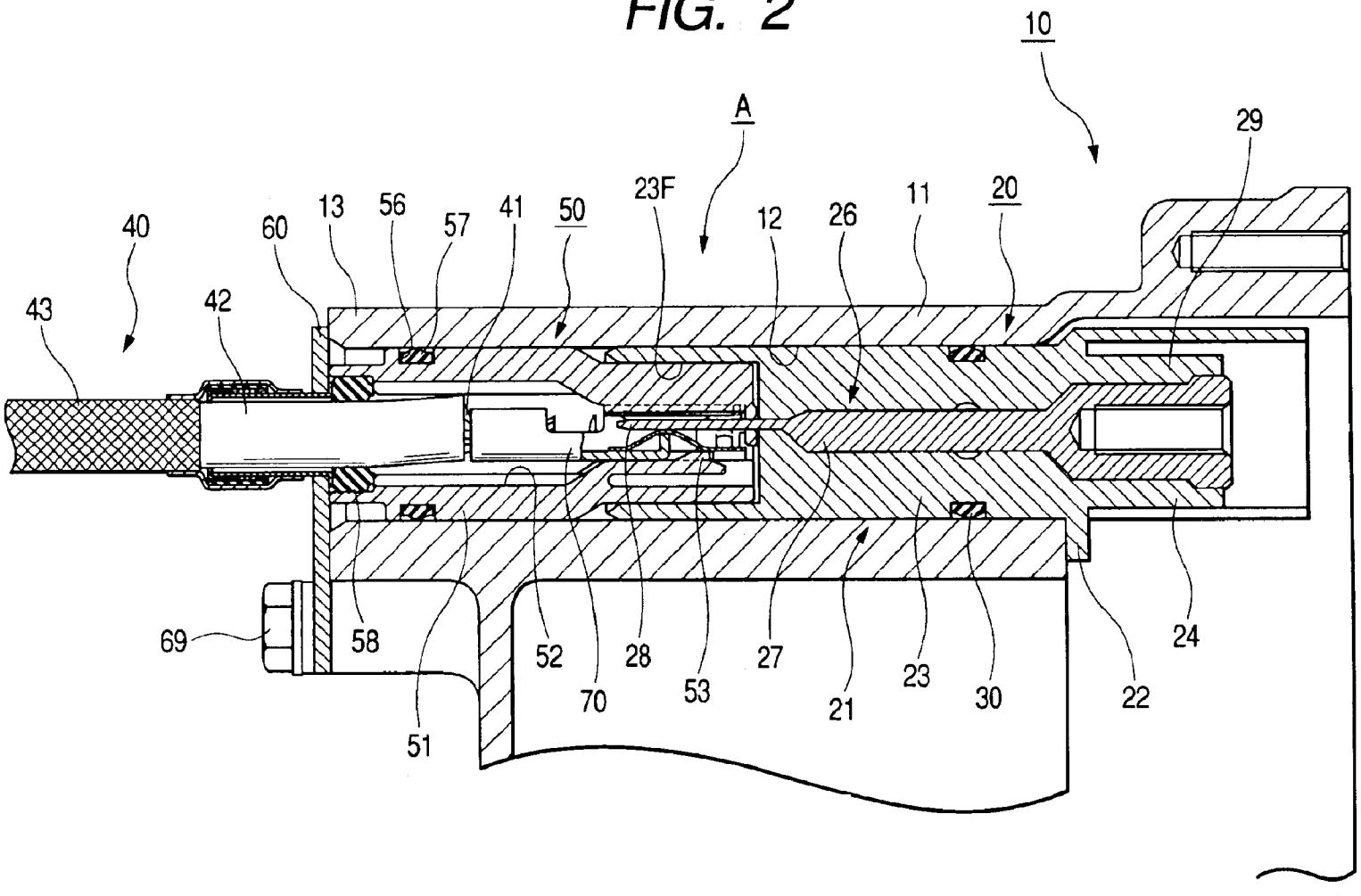
FIG. 2 is a vertical sectional view of the integrated state.

As shown by FIG. 1 and FIG. 2, in a structure A of connecting an electric wire to a shield case of an apparatus according to the embodiment, an electric wire side connector 50 is connected to a distal end portion of a conductor 41 constituting a core line of a shield electric wire 40, a shield layer 43 of the shield electric wire 40 is connected to a shield case 11 of an apparatus 10 (for example, an inverter apparatus of an electric car), and an electric wire side terminal 70 provided at the electric wire side connector 50 is connected to an electric wire side terminal 26 at inside of the shield case 11.

The apparatus 10 is constituted by containing an apparatus main body (not illustrated) at inside of the conductive shield case 11 and containing an apparatus side connector 20 connected to the apparatus main body similarly at inside of the shield case 11. At an upper end portion of a side wall of the shield case 11, three left and right circular attaching holes 12 (through holes which are constituent elements of the invention) penetrated in a front and rear direction are formed at a constant pitch. There is formed a bulged portion 13 in a mode of projecting opening regions of the three attaching holes 12 and peripheral edge regions thereof to an outer side at an outer face of the shield case 11. An outer periphery of the bulged portion 13 is constituted by a comparatively simple shape (for example, an oval shape, a rectangular shape corners of which are rounded in an arc-like shape a trapezoidal shape corners of which are rounded in an arc-like shape, or the like) by making flat faces and curved faces smoothly continuous, a projected end face (left end face in FIG. 1 and FIG. 2) of the bulged portion 13 is opened with the three attaching holes 12, and opened with three female screw holes (not illustrated) disposed on skewed lower sides of the respective attaching holes 12.

The apparatus side connector 20 is provided with an apparatus side housing 21 made of a synthetic resin and the three apparatus side terminals 26. The apparatus side housing 21 is constituted by a connecting portion 22 comprising a single part and formed by substantially an oval shape slender in a left and right direction, and fitting portions 23 (housing elements) constituting a shape of substantially three left and right circular pillars projected from the connecting portions 22 to a front side (left side of FIG. 1). That is, there is constituted a mode in which a plurality of the housing elements are made to be integrally continuous by the connecting portion 22. The connecting portion 22 is formed with three left and right cylindrical portions 24 projected from a rear end face thereof to a rear side coaxially with the respective fitting portions 23 and formed with a pair of left and right plate-like attaching portions 25 projected from two left and right end portions thereof in side directions.

As shown by FIG. 2, FIG. 7 to FIG. 9, inside of the apparatus side housing 21 is embedded with the three apparatus side terminals 26 in correspondence with the respective fitting portions 23 and the respective cylindrical portions 24 by insert molding. The apparatus side terminal 26 is constituted by a terminal main body 27 penetrating the fitting portion 23 in the front and rear direction, a tab 28 (fitting projected portion) projected from the terminal main body 27 to the front side and facing a containing portion 23F in a recess shape at a front end portion of the fitting portion 23 and an apparatus connecting portion 29 projected from the terminal main body 27 to the rear side and facing the cylindrical portion 24 and the apparatus connecting portion 29 is connected with a conductive member of a cable or the like extended from the apparatus main body. Further, an outer periphery of each of the fitting portions 23 is mounted with a seal ring 30.

Further, as shown by FIG. 1, such an apparatus side connector 20 is integrated to the shield case 11 in a state in which the respective fitting portions 23 are tightly fitted from an inner side of the shield case 11 to the attaching holes 12 and the connecting portion 22 and the plate-like attaching portions 25 are brought into contact with an inner face of the shield case 11 and integrated to the shield case 11 by bolts (not illustrated) penetrated to bolt holes 25H of the plate-like attaching portions 25. In an integrated state shown by being enlarged in FIG. 2, at inside of each of the attaching holes 12, the containing portion 23F and the tab 28 at inside thereof are at standby for being connected with the electric wire side connector 50 and the electric wire side terminal 70. Further, a clearance between the attaching hole 12 and the fitting portion 23 is waterproofed by the seal ring 30.

As shown by FIG. 1, the shield electric wire 40 is constituted by surrounding an outer periphery of the conductor 41 by a core 42 comprising an insulating resin material and providing the cylindrical shield layer 43 constituted by knitting metal slender wires in a mesh-like shape to cover the outer periphery of the core 42 and the shield electric wire 40 is brought into a state of exposing the shield layer 43 over an entire length thereof. At the distal end portion of the shield electric wire 40, there is brought about a state in which an end portion of the core 42 is exposed by shortly cutting an end portion of the shield layer 43 and an end portion of the conductor 41 is exposed by removing the distal end portion of the core 42. The shield wires 40 are wired in a state of summarizingly bundling three pieces thereof.

Large portions of the shield electric wires 40 excluding the end portions are inserted into a corrugated tube 45. Further, the end portions of the shield electric wires 40 are surrounded by a rubber boot 46. The corrugated tube 45 is made of a synthetic resin, constituting a cylindrical bellows-like shape as a whole are made to be able to be flexibly deformed along wiring paths of the shield electric wires 40 in a state of containing the shield electric wires 40 at inside thereof. The rubber boot 46 is formed by a shape constituting a cylindrical shape as a whole and widening a width thereof toward the front side. A front end portion of the rubber boot 46 constitutes a large diameter outwardly fitting portion 47 outwardly fit to the bulged portion 13 of the shield case 11 and an inner periphery thereof is formed with a lip portion 48 extended in a peripheral direction. Meanwhile, a rear end portion of the rubber boot 46 constitutes a circular small diameter outwardly fitting portion 49 outwardly fitted to an end portion of the corrugated tube 45 and an inner periphery thereof is formed with recessed and projected portions matching a shape of an outer periphery of the corrugated tube 45.

Figure 3:
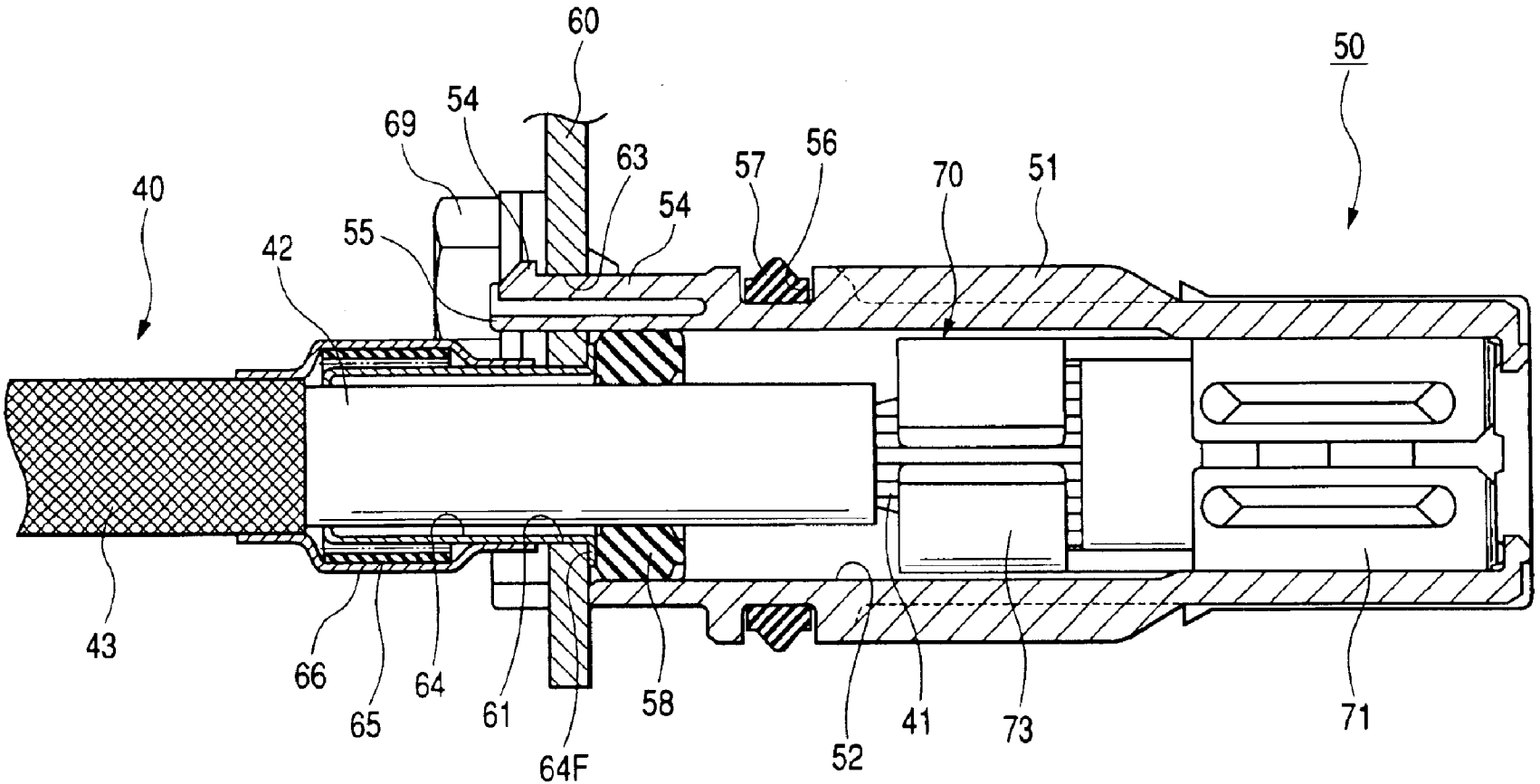
FIG. 3 is a horizontal sectional view enlarging an electric wire side connector.
Figure 4:
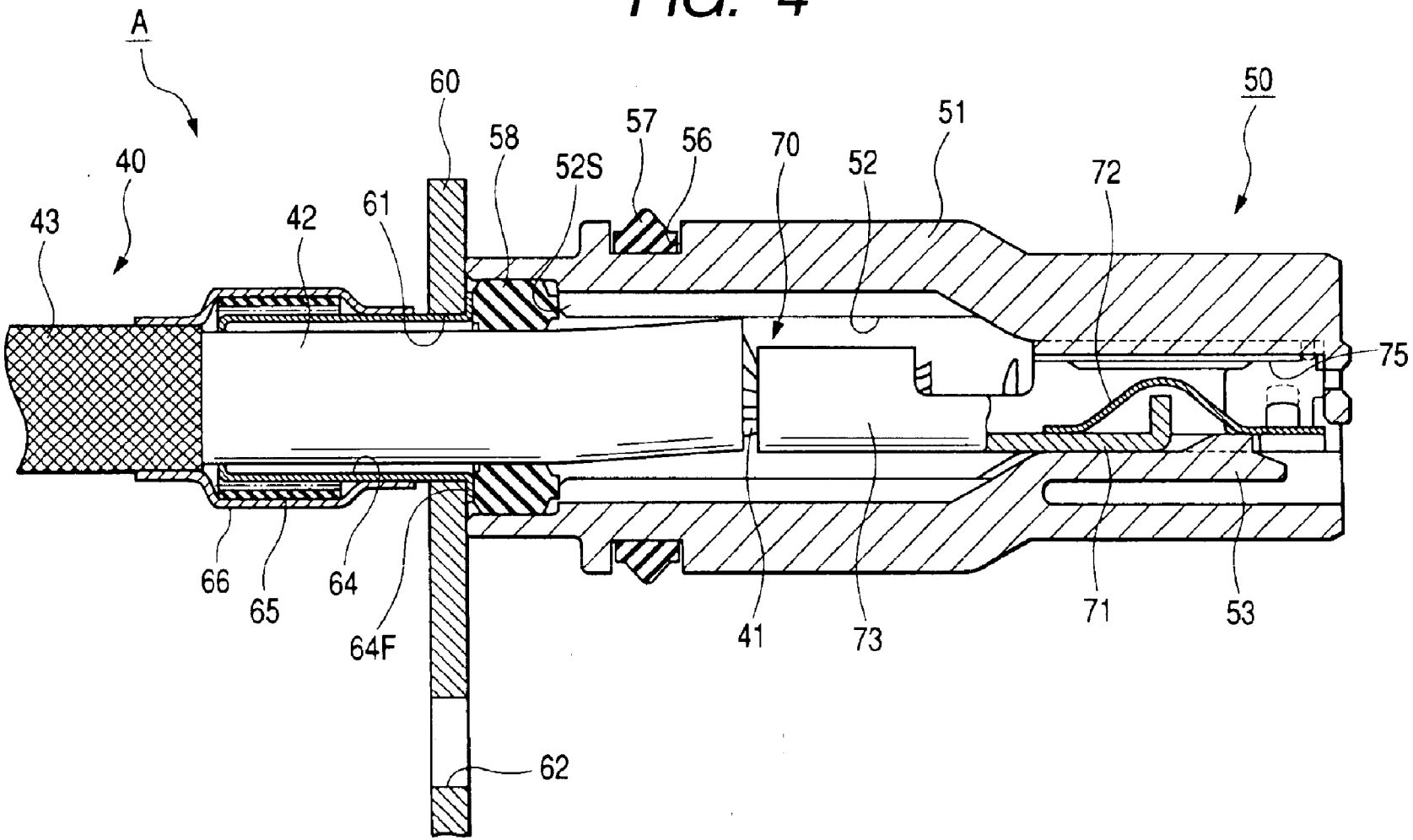
FIG. 4 is a vertical sectional view enlarging the electric wire side connector.
Figure 5:
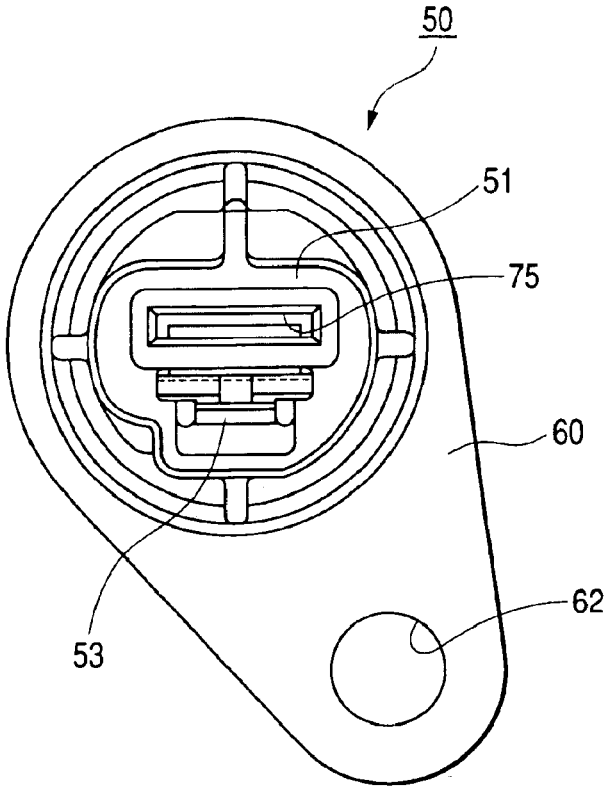
FIG. 5 is a front view of the electric wire side connector.
Figure 6:
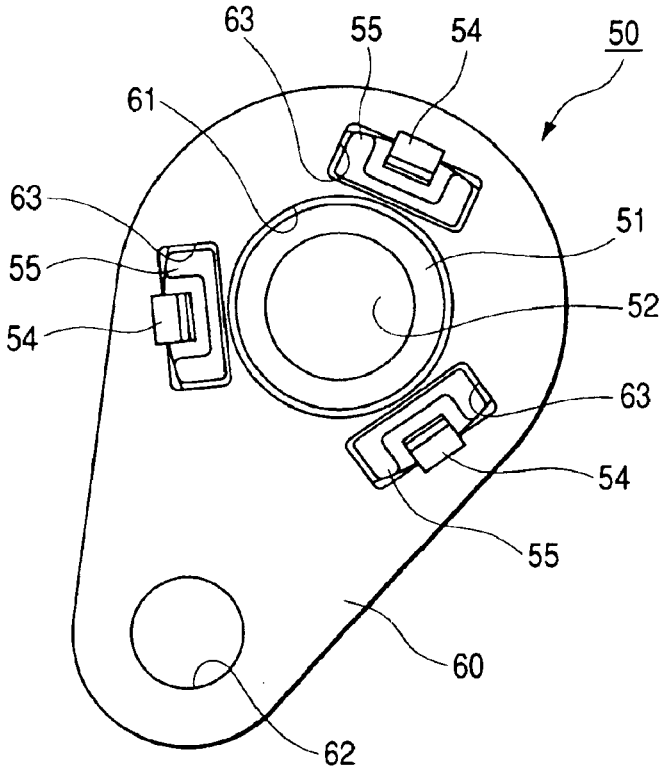
FIG. 6 is a rear view of the electric wire side connector.
Figure 7:
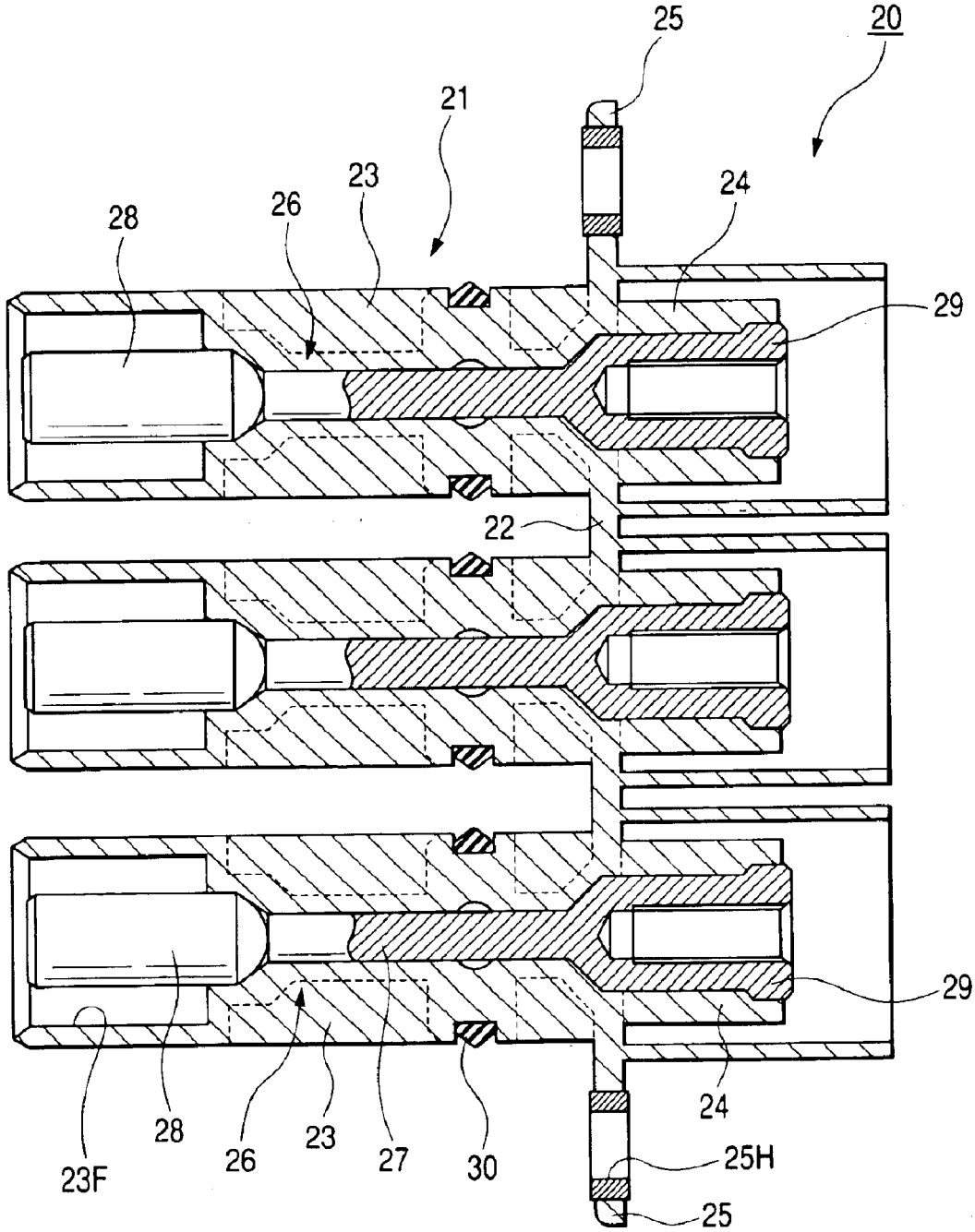
FIG. 7 is a horizontal sectional view of an apparatus side connector.
Figure 8:
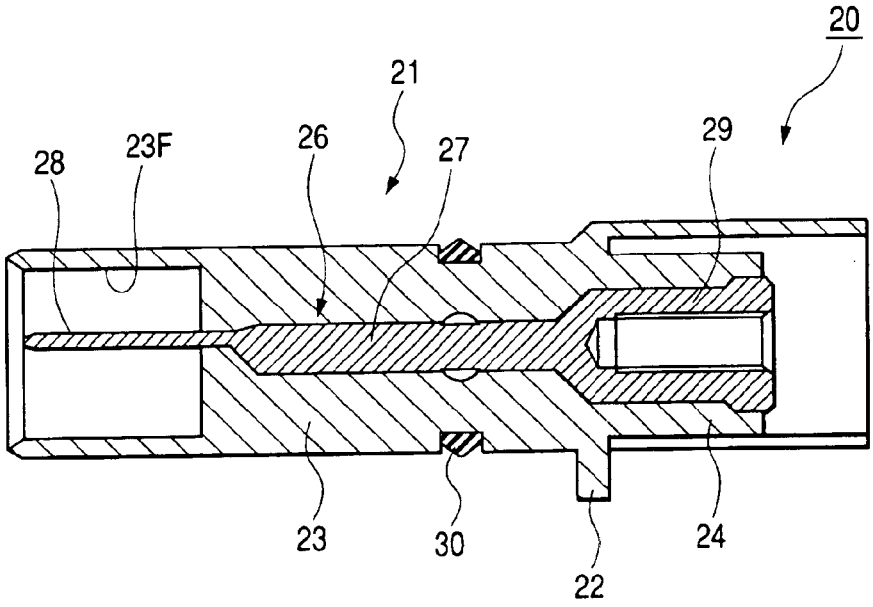
FIG. 8 is a vertical sectional view of the apparatus side connector.
Figure 9:
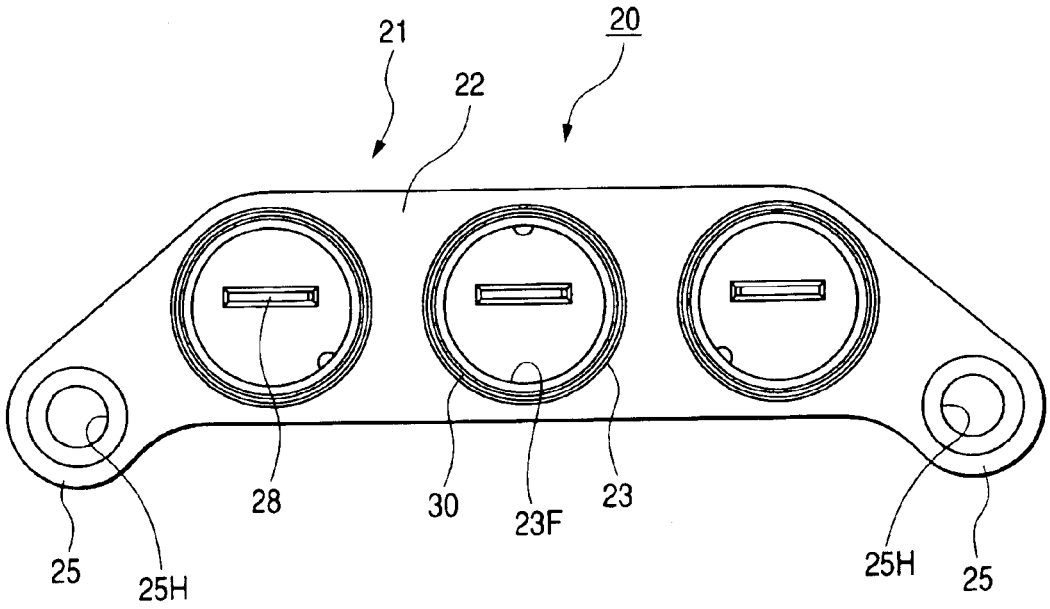
FIG. 9 is a front view of the apparatus side connector.

As shown by FIG. 2 through FIG. 6, the electric wire side connector 50 is constituted by including an electric wire side housing 51, a bracket 60, and the electric wire side terminal 70. The electric wire side housing 51 is made of a synthetic resin and constitutes substantially a cylindrical shape as a whole. Inside of the electric wire side housing 51 is formed with a cavity 52 in a circular shape penetrated between two front and rear end faces thereof and is formed with a lance 53 for preventing the electric wire side terminal 70 from being drawn out on a lower face side of a front end portion of the cavity 52. As shown by FIG. 3 and FIG. 6, a rear end portion of the outer periphery of the electric wire side housing 51 is formed with three elastic locking pieces 54 extended to the rear side in a cantilever shape, and three protecting pieces 55 projected to the rear side in a cantilever shape to protect the elastic locking pieces 54 from inner peripheral sides and two sides in peripheral directions in a mode at intervals in the peripheral direction and projected to the rear side further from the rear end face of the electric wire side housing 51. A seal groove 56 formed at the outer periphery of the electric wire side housing 51 is mounted with a seal ring 57 as a seal member.

The bracket 60 comprises a conductive material of a metal or the like and constitutes a plate-like shape substantially in an eng-like shape as a whole as shown by FIG. 5 and FIG. 6. The bracket 60 is formed with a center hole 61 constituting a circular shape having a diameter smaller than that of the cavity 52 penetrated in the front and rear direction and formed with a bolt hole 62 to penetrate in the front and rear direction at a position eccentric from the center hole 61. Further, the bracket 60 is formed with three locking holes 63 along a circle concentric with the center hole 61 to correspond to the elastic locking pieces 54 and the protecting pieces 55.

As shown by FIG. 3 and FIG. 4, the bracket 60 is conductively connected to the shield layer 43 of the shield electric wire 40 by interposing an under pipe 64 and a calking ring 65. That is, a clearance between a front end portion of the shield layer 43 and an outer periphery of the core 42 is inserted with a rear end portion of the conductive under pipe 64 from a front side thereof, the front end portion of the shield layer 43 is outwardly fit with the conductive calking ring 65, and by calking the calking ring 65 to the inner peripheral side, the front end portion of the shield layer 43 is fixed in a state of being squeezed between the pipe 64 and the calking ring 65. Further, the under pipe 64 is previously inserted from the front side to the center hole 61 of the bracket 60 and restricted from being drawn to the rear side from the bracket 60 by locking a flange portion 64F at the front end portion to a front face of the bracket 60 and is restricted in idle movement thereof in a diameter direction relative to the bracket 60 by being fit to the inner periphery of the center hole 61. Further, by bringing the front end portion and the flange portion 64F of the under pipe 64 to the inner periphery and the front face of the center hole 61 of the bracket 60, the shield layer 43 is conductively connected to the bracket 60 via the under pipe 64. Further, the calking ring 65 and a region forward therefrom and a region rearward therefrom are outwardly fit with a rubber ring 66. According to the embodiment, the under pipe 64 and the calking ring 65 function as connecting member.

The electric wire side terminal 70 is slender as a whole in the front and rear direction, a substantially a front half portion thereof is formed with an apparatus connecting portion 71 connected to the tab 28 of the apparatus side terminal 26 and constituting substantially a square cylinder shape, inside of the apparatus connecting portion 71 is provided with an elastic contact piece 72 and a lower face of the apparatus connecting portion 71 is formed with a lance hole 73. Meanwhile, substantially a rear half portion of the electric wire side terminal 70 is made to constitute an electric wire press contact portion 74 and the electric wire press contact portion 74 is conductively connected with the front end portion of the conductor 41 of the shield electric wire 40 exposed from the core 42.

The electric wire side connector 50 is integrated as follows.

First, the shield electric wire 40 is inserted into the center hole 61 of the bracket 60 and the front end portion of the shield layer 43 is connected to the bracket 60 via the under pipe 64 and the calking ring 65. Next, a seal member 58 made of rubber is outwardly fitted to the core 42 of the shield electric wire 40 from the front side and the seal member 58 is brought into contact with the flange portion 64F of the under pipe 64 to press to the front face of the bracket 60. The seal member 58 is restrained from idly moving relative to the outer periphery of the core 42 by friction. Thereafter, the electric wire press contact portion 74 of the electric wire side terminal 70 is fixedly attached to the front end portion of the conductor 41 of the shield electric wire 40. The electric wire side terminal 70 is connected to the front end portion of the shield electric wire 40 by the above-described.

Next, the shield electric wire 40, the bracket 60 and the electric wire side terminal 70 are integrated to the electric wire side housing 51. In the integrating operation, the electric wire side terminal 70 is inserted into the cavity 52 from the rear side. The electric wire side terminal 70 deeply inserted to a regular position is stopped in forward movement thereof by bringing the apparatus connecting portion 71 into contact with a front wall of the cavity 52 and is prevented from being drawn out therefrom by locking the lance 53 to the lance hole 73. Further, the seal member 58 outwardly fitted to the core 42 is brought into close contact with the inner periphery of the rear end portion of the cavity 52, thereby, an interval between the inner periphery of the cavity 52 and the outer periphery of the core 42 is sealed in a state of restricting invasion of water.

In accordance with inserting the electric wire side terminal 70 into the cavity 52, the bracket 60 becomes proximate to the electric wire side housing 51 from the rear side, each of the locking holes 63 of the bracket 60 is penetrated with the elastic locking piece 54 and the protecting piece 55 of the elastic wire side housing 51 from the front side, a locking claw 54A at the rear end of the elastic locking piece 54 is locked to a hole edge on the outer peripheral side of the locking hole 63 from the rear side and by locking the elastic locking piece 54 and the locking hole 63, the bracket 60 is restricted from being separated from the electric wire side housing 51 to the rear side. In the locking state, the front face of the bracket 60 is brought into contact with the rear end face of the electric wire side housing 51 from the rear side, thereby, the bracket 60 is restricted from being displaced to the front side relatively from the electric wire side housing 51. That is, the bracket 60 is locked in a state of being integrated to the electric wire side housing 51. In the tacked locking state, the seal member 58 is squeezed between the flange portion 64F and a stopper 52S of the cavity 52, the flange portion 64F is pressed to the bracket 60 by an elastic repulsive force of the seal member 58 and the under pipe 64 and the bracket 60 are firmly brought into contact with each other.

When the electric wire side connector 50 has finished to integrate, three pieces of the shield electric wires 40 are contained at inside of the corrugated tube 45 in a state of being bundled in a laminated state. The corrugated tube 45 is formed with divided grooves (not illustrated) along a length direction thereof and by expanding the divided grooves, the shield electric wires 40 can be contained at inside thereof. Further, the rubber boot 46 is covered on distal end portions of three pieces of the shield electric wire 40 and at this occasion, the rubber boot 46 may be inserted with the three electric wire side terminals 70 while elastically expanding to open the small diameter outwardly fitting portion 49 at a rear end portion thereof. By outwardly fitting the small diameter outwardly fitting portion 49 of the rubber boot 46 to the front end portion of the corrugated tube 45, the corrugated tube 45 and the rubber boot 46 are integrated to surround the shield electric wires 40 over a total length thereof.

The electric wire side housings 51 of the electric wire side connector 50 are respectively fit to the respective attaching holes 12 of the shield case 11. At inside of the attaching hole 12, the apparatus side housing 21 is previously prepared, and when the bracket 60 is fit with the electric wire side housing 51 sufficiently deeply to a state of being brought into contact with the outer face of the shield case 11, the front end portion is fit to the containing portion 23F of the apparatus side housing 21 and the tab 28 advances into a fitting recess portion 75 in the apparatus connecting portion 71 of the electric wire side terminal 70 to be brought into elastic contact with the elastic contact piece 72 to thereby conductively connect the two terminals 26, 70.

In a state of fitting the electric wire side housing 51 to the attaching hole 12, the bolt hole 62 of the bracket 60 is matched to the female screw hole of the shield case 11, by screwing a bolt 69 penetrated into the bolt hole 62 to the female screw hole to fasten, the bracket 60 is fixed in a state of conductively connected to the outer wall face of the shield case 11 and therefore, the shield layer 43 of the shield electric wire 40 is conductively connected to the shield case 11. Further, since the bracket 60 is brought into contact with the outer end face of the electric wire side housing 51, the electric wire side housing 51 is restricted from being drawn out from the attaching hole 12 to the outer side (rear side).

Further, the large diameter outwardly fitting portion 47 at the front end of the rubber boot 46 is outwardly fitted to the bulged portion 13 of the shield case 11 and the lip portion 48 is brought into elastic contact with the outer periphery. Thereby, the connected portion between the bracket 60 and the shield layer 43 is brought into a state of being waterproofed. Further, an interval between the inner periphery of the attaching hole 12 and the outer periphery of the electric wire side housing 51 is waterproofed by the seal ring 57.

As described above, according to the embodiment, although the shield electric wire 40 is not provided with a sheath for protecting the shield layer 43, the entire length of the shield electric wire 40 (at least a region of the shield electric wire 40 exposing the shield layer 43) is contained in the corrugated tube 45 and the rubber boot 46 to protect. In this way, according to the embodiment, the sheath can be dispensed with from the shield electric wire 40 and therefore, it is realized that the small diameter formation and the light-weighted formation of the seal electric wire 40 are carried out by an amount of the sheath and a bending rigidity thereof is reduced.

Further, the electric wire side terminal 70 is held by the electric wire side housing 51, the electric wire side housing 51 is fit to the attaching hole 12 of the shield case 11 and therefore, the electric wire side terminal 70 can be positioned relative to the shield case 11 and the apparatus side terminal 26 in the diameter direction and in the front and rear direction, thereby, operability is promoted in connecting the two terminals 26, 70.

Further, at the rear external portion of the electric wire side housing 51, the shield layer 43 is connected to the bracket 60, the bracket 60 is attached to the shield case 11, the front end portion of the core 42 is inserted into the electric wire side housing 51 and the seal member 58 is provided between the electric wire side housing 51 and the core 42. That is, the shield processing structure (a structure of connecting the shield layer 43 and the bracket 60) at the distal end of the shield electric wire 40, and a water proof structure between the shield electric wire 40 and the electric wire side housing 51 (a structure of providing the seal member 58 between the core 42 and the electric wire side housing 51) are divided to outside and inside of the electric wire side housing 51 and therefore, simplification of the structures is realized.

Further, the elastic locking piece 54 and the locking hole 63 are provided as tackedly locking member for tackedly locking the bracket 60 and the electric wire side housing 51 and therefore, the bracket 60 and the electric wire side housing 51 can be handled in a state of being integrated to each other and operability in integrating the shield case 11 is improved.

Further, in a state of integrating the bracket 60 and the electric wire side housing 51 to the shield case 11, there is constructed a constitution in which the bracket 60 is brought into contact with the electric wire side housing 51 from the rear side in the integrating direction and the bracket 60 serves also as member for preventing the electric wire side housing 51 from being drawn out. Thereby, member for preventing the electric wire side housing 51 from being drawn is dispensed with and simplification of the structure is realized.

Further, the apparatus side terminal 26 is held by the apparatus side housing 21, the apparatus side housing 21 is provided at inside of the attaching hole 12, the apparatus side terminal 26 and the electric wire side terminal 70 are connected by fitting the electric wire side housing 51 to the apparatus side housing 21 at inside of the attaching hole and therefore, connection between the apparatus side terminal 26 and the electric wire side terminal 70 is carried out by only fitting the apparatus side housing 21 and the electric wire side housing 51 to each other. Therefore, it is not necessary to directly connect the terminals 26, 70 by troublesome bolt fastening operation, which is excellent in operability. Further, although when the terminals are connected by fastening the bolt, it is necessary to cover a cover for protection at a portion of connecting the terminals after fastening the bolt, according to the embodiment, the two terminals 26, 70 are brought into a state of being contained at inside of the attaching hole 12 and therefore, it is not necessary to cover the cover for protection.

The invention is not limited to the embodiment explained by the above-described description and drawings but, for example, following embodiments are also included in the technical range of the invention, further, the invention can be embodied by being variously changed within the range not deviated from the gist other than described below.

(1) Although according to the above-described embodiment, the plurality of electric wire side housings are provided respectively independently from each other, the electric wire side housing may be constituted as an integrally continuous housing similar to the apparatus side housing.

(2) Although according to the above-described embodiment, the apparatus side housing is constituted in the mode in which a plurality of housing elements are integrally continuous, similar to the electric wire side housing of the first embodiment, there may be constituted a constitution in which respectively independent housings are inserted into the respective attaching holes.

(3) Although according to the above-described embodiment, the apparatus side terminal is integrated to the apparatus side housing by insert molding, there may be constituted a state of inserting the apparatus side terminal to the apparatus side housing to contain.

(4) Although according to the above-described embodiment, there is constituted the state of inserting the electric wire side terminal to the electric wire side housing to contain, according to the embodiment, the electric wire side terminal and the electric wire side housing may be integrated by insert molding.

(5) Although according to the above-described embodiment, there is provided the member for tackedly locking the bracket and the electric wire side housing, according to the invention, there may be constructed a constitution of not providing the tackedly locking member.

(6) Although according to the embodiment, there is constructed the constitution in which the bracket serves also as the function of preventing the electric wire side housing from being drawn, according to the invention, the electric wire side housing may be prevented from being drawn by member other than the bracket.

(7) Although according to the embodiment, there is exemplified a sheathless structure in which the sheath for protecting the shield layer of the shield electric wire is not provided, the sheath may be provided at a surrounding of the shield layer of each of the shield electric wires. For example, the sheath may be arranged to summarizingly cover three pieces of the shield electric wires shown in FIG. 1.

What is claimed is:

1. A connecting structure, comprising a metal shield case and a shield electric wire, wherein:

the metal shield case includes:

an insulative first housing fixed in a state of being inserted into a through hole of the metal shield case;

a first terminal held by the first housing;

a seal ring provided at least on an outer periphery of the first housing for sealing an interval between the outer periphery of the first housing and the through hole; and a metal bracket fixed to the metal shield case; and the shield electric wire includes:

a center wire;

a shield layer around the center wire electrically connected to the metal bracket;

an insulative second housing fitted to the first housing by being inserted into the through hole; and a second terminal connected to the center wire of the shield electric wire and connected to the first terminal in fitting the second housing and the first housing to each other.

2. The connecting structure according to claim 1, wherein the metal bracket is integrally provided with the insulative second housing, and the metal bracket is fixed to the metal shield case, thereby fixing the insulative second housing in a state of the insulative second housing being fit to the insulative first housing.

3. The connecting structure according to claim 1, wherein:

the first terminal further includes a terminal main body extending through the insulative first housing, and a fitting projected portion extending from the terminal main body;

the second terminal includes a fitting recess portion that receives the fitting projected portion; and the first and second terminals are connected by fitting the fitting projected portion and the fitting recess portion to each other.

4. The connecting structure according to claim 1, wherein the shield electric wire comprises a plurality of the shield electric wires, and the first and second terminals comprise a plurality of first and second terminals that correspond respectively to the shield electric wires.

5. The connecting structure according to claim 4, wherein the through hole comprises a plurality of through holes, and the insulative first housing and/or the insulative second housing comprises a plurality of housing elements inserted respectively into the through holes, the plurality of housing elements being integrally formed to be continuous with each other at portions external to the through holes.

6. The connecting structure according to claim 1, further comprising:

connecting member that connects the metal bracket and the shield layer at a portion external to the insulative second housing;

an inner portion of the insulative second housing including a cavity into which the shield electric wire is inserted; and a sealing member that seals between the shield electric wire and the second insulative housing, the sealing member being arranged inside the cavity.

* * * * *